US009297095B2

(12) United States Patent
Yu

(10) Patent No.: US 9,297,095 B2
(45) Date of Patent: Mar. 29, 2016

(54) PENETRATION-RESISTANT FABRIC MANUFACTURING METHOD WHICH PREVENTS YARN BREAKAGE DURING THE MANUFACTURING PROCESS

(76) Inventor: King Yeung Yu, N.T. (HK)

( * ) Notice: Subject to any disclaimer, the term of this patent is extended or adjusted under 35 U.S.C. 154(b) by 0 days.

(21) Appl. No.: 12/833,010

(22) Filed: Jul. 9, 2010

(65) Prior Publication Data

US 2012/0005844 A1 Jan. 12, 2012

(51) Int. Cl.

| | |
|---|---|
| ***D03D 3/02*** | (2006.01) |
| ***D03D 15/00*** | (2006.01) |
| ***D04H 3/14*** | (2012.01) |
| ***D06P 3/82*** | (2006.01) |
| ***D03D 1/00*** | (2006.01) |
| ***D06P 5/20*** | (2006.01) |

(52) U.S. Cl.

CPC ..... *D03D 3/02* (2013.01); *D03D 1/0035* (2013.01); *D03D 15/0027* (2013.01); *D06P 3/8204* (2013.01); *D06P 5/2077* (2013.01); *D10B 2401/041* (2013.01); *D10B 2501/02* (2013.01)

(58) Field of Classification Search

USPC ..... 8/490

See application file for complete search history.

(56) References Cited

U.S. PATENT DOCUMENTS

| | | | | |
|---|---|---|---|---|
| 4,019,311 | A * | 4/1977 | Schippers | 57/245 |
| 6,071,578 | A * | 6/2000 | Richardson | A41C 3/0007 156/181 |
| 2007/0214765 | A1 * | 9/2007 | Teshima | D02G 3/32 57/293 |
| 2008/0163953 | A1 * | 7/2008 | Glenn et al. | 139/387 R |
| 2010/0051132 | A1 * | 3/2010 | Glenn | A41C 3/12 139/387 R |

OTHER PUBLICATIONS

"Weaving" entry on Thesaurus.com. Roget's 21st Century Thesaurus, Third Edition. Philip Lief Group 2009. http://thesaurus.com/browse/weaving (accessed: Jul. 11, 2014), attached as a PDF (one PDF shows the definitions, the other PDF shows the linked Citations page).*

* cited by examiner

*Primary Examiner* — Harold Pyon
*Assistant Examiner* — Katie L Hammer

(57) ABSTRACT

The present penetration-resistant fabric manufacturing method which prevents yarn breakage during the manufacturing process comprises the steps of: (i) blending a fusible yarn and a support yarn to form a blended yarn; (ii) the blended yarn and an elastomeric yarn are formed into a fabric; (iii) treating the fabric by heating so that the fusible yarn melts and spreads over the fabric; and (iv) cooling the fabric to form a penetration barrier. The present invention prevents yarn breakage during the manufacturing process.

11 Claims, No Drawings

PENETRATION-RESISTANT FABRIC MANUFACTURING METHOD WHICH PREVENTS YARN BREAKAGE DURING THE MANUFACTURING PROCESS

BACKGROUND OF THE INVENTION

The present invention relates to a penetration-resistant fabric manufacturing method and more particularly pertains to a penetration-resistant fabric manufacturing method which prevents yarn breakage during the manufacturing process.

The prior art has provided a tubular fabric for receiving underwire of brassiere which comprises a support yarn, an elastomeric yarn and a fusible yarn. The fusible yarn can be melted at a predetermined temperature and adhered to other yarns of the fabric to form a penetration barrier, and on cooling the melted fusible yarn produces a coating which has a temperature in excess of the predetermined temperature. The resultant tubular fabric is capable of preventing underwire protrusion by the penetration barrier formed by the fusible yarn, and the penetration barrier is durable as it would not be melted under normal circumstances, even when the fabric is subject to a washing machine for cleaning and drying.

However, fusible yarns are relatively fragile and easy to break. The fusible yarns are easily broken during the weaving process and thereby jamming the loom. Extra effort is required to handle the jamming of the loom and productivity is therefore affected.

BRIEF SUMMARY OF THE INVENTION

In view of the aforesaid disadvantages now present in the prior art, the present invention provides a penetration-resistant fabric manufacturing method which prevents yarn breakage during the manufacturing process.

To attain this, the penetration-resistant fabric manufacturing method which prevents yarn breakage during the manufacturing process comprises the steps of: (i) blending a fusible yarn and a support yarn to form a blended yarn; (ii) forming the blended yarn and an elastomeric yarn into a fabric; (iii) treating the fabric by heating so that the fusible yarn melts and spreads over the fabric; and (iv) cooling the fabric to form a penetration barrier.

In a preferred embodiment, the support yarn is made from a polyamide such as Nylon. In other embodiments, the support yarn could be polyester. The blended yarn comprises 22.2% by weight of the fusible yarn and 77.8% by weight of the support yarn. The fusible yarn and the support yarn are blended by a two-for-one twister to form the blended yarn. The yarns are formed into a fabric in form of a tubular tape by weaving. The fabric comprises 22.1% by weight of the blended yarn. Apart from the blended yarn and the support yarn, the fabric may further comprise nylon. The fabric may be treated by heating during a dyeing process. The dyeing process comprises the steps of (i) steaming the fabric in a steamer at 102-105° C. for dye fixing and (ii) drying the fabric in a drying unit at 80-110° C.

The fabric or tubular tape may be used for receiving underwire of brassiere, or for other purposes for all tapes.

The manufacturing process of the present invention is effective to prevent breakage of yarns during the weaving process. Blending a fusible yarn and a support yarn to form a blended yarn provides a stronger yarn in comparison to a conventional fusible yarn. Therefore, when feeding the blended yarn into the weaving loom, the blended yarn is less susceptible to breakage. As a result, loom jamming could be prevented and productivity is increased. For example, when a fabric is formed by weaving a Nylon, a Lycra and a conventional fusible yarn model no. 56D/12F, the frequency of yarn breakage during the weaving process is about once per 1.5 hours. However, when the manufacturing process of the present invention is applied, i.e. blending a fusible yarn and a support yarn to form a blended yarn first and then weaving the blended yarn and an elastomeric yarn to form a fabric, the frequency of yarn breakage during the weaving process is reduced to about once per 12 hours.

DETAILED DESCRIPTION OF THE INVENTION

In a preferred embodiment, the present penetration-resistant fabric manufacturing method which prevents yarn breakage during the manufacturing process comprises the steps of: (i) blending a fusible yarn and a support yarn to form a blended yarn; (ii) forming the blended yarn and an elastomeric yarn into a fabric; (iii) treating the fabric by heating so that the fusible yarn melts and spreads over the fabric; and (iv) cooling the fabric to form a penetration barrier. Particularly, the support yarn is made from a Nylon under model number 78/24/2 provided by Guangdong Xinhui Meida Nylon Co., Ltd. In other embodiments, the support yarn could be polyester. The fusible yarn in this embodiment is model no. 56/12/1 provided by Lokpoon & Co., Ltd. The blended yarn comprises 22.2% by weight of the fusible yarn and 77.8% by weight of the support yarn. The fusible yarn and the support yarn are blended by a two-for-one twister under model no. ASKV741 provided by Changzhou Peixing Textile Machinery Manufacturing Co., Ltd. to form the blended yarn. The settings and operation of a two-for-one twister is readily available in the prior art and are therefore not described in detail herein. The yarns are formed into a fabric in form of a tubular tape by weaving. The weaving process is done by a weaving loom under model no. MULLER NF 27/6. The settings and operation of a weaving loom is readily available in the prior art and are therefore not described in detail herein. The fabric comprises 22.1% by weight of the blended yarn. Apart from the blended yarn and the support yarn, the fabric in this case further comprises nylon. The fabric is treated by heating during a dyeing process. The dyeing process comprises the steps of (i) steaming the fabric in a steamer at 102-105° C. for dye fixing and (ii) drying the fabric in a drying unit at 80-110° C. The dyeing, heating and cooling processes are well-known to a person skilled in the art and are therefore not described in detail herein.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A penetration-resistant fabric manufacturing method which prevents yarn breakage during the manufacturing process, comprising the steps of:

(i) blending a fusible yarn and a support yarn to form a blended yarn; wherein the blended yarn comprises 22.2% by weight of the fusible yarn and 77.8% by weight of the support yarn;

(ii) forming the blended yarn and an elastomeric yarn into a fabric by weaving;

(iii) treating the fabric by heating so that the fusible yarn melts and spreads over the fabric;

(iv) cooling the fabric to form a penetration barrier.

2. The penetration-resistant fabric manufacturing method which prevents yarn breakage during manufacturing of a fabric as in claim 1, wherein the support yarn is made from a polyamide.

3. The penetration-resistant fabric manufacturing method which prevents yarn breakage during manufacturing of a fabric as in claim 1, wherein the support yarn is Nylon.

4. The penetration-resistant fabric manufacturing method which prevents yarn breakage during manufacturing of a fabric as in claim 1, wherein the support yarn is polyester.

5. The penetration-resistant fabric manufacturing method which prevents yarn breakage during manufacturing of a fabric as in claim 1, wherein step (i) comprises blending the fusible yarn and the support yarn by a two-for-one twister to form the blended yarn.

6. The penetration-resistant fabric manufacturing method which prevents yarn breakage during manufacturing of a fabric as in claim 1, wherein the weaving in step (ii) comprises forming the fabric in the form of a tubular tape.

7. The penetration-resistant fabric manufacturing method which prevents yarn breakage during manufacturing of a fabric as in claim 1, wherein the fabric comprises 22.1% by weight of the blended yarn.

8. The penetration-resistant fabric manufacturing method which prevents yarn breakage during manufacturing of a fabric as in claim 1, wherein the fabric further comprises nylon.

9. The penetration-resistant fabric manufacturing method which prevents yarn breakage during manufacturing of a fabric as in claim 1, wherein step (iii) comprises treating the fabric by heating during a dyeing process.

10. The penetration-resistant fabric manufacturing method which prevents yarn breakage during manufacturing of a fabric as in claim 9, wherein the dyeing process comprises the steps of (i) steaming the fabric in a steamer at 102-105° C. for dye fixing and (ii) drying the fabric in a drying unit at 80-110° C.

11. The penetration-resistant fabric manufacturing method which prevents yarn breakage during manufacturing of a fabric as in claim 1, wherein the fabric is for use in receiving underwire of brassiere.

* * * * *